US009593892B2

(12) United States Patent
Wolf et al.

(10) Patent No.: US 9,593,892 B2
(45) Date of Patent: Mar. 14, 2017

(54) HEAT EXCHANGER AND RETENTION ELEMENT

(71) Applicant: Behr GmbH & Co. KG, Stuttgart (DE)

(72) Inventors: Walter Wolf, Oppenweiler-Zell (DE); Harald Mühleisen, Leinfelden-Echterdingen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 226 days.

(21) Appl. No.: 14/044,923

(22) Filed: Oct. 3, 2013

(65) Prior Publication Data

US 2014/0096932 A1 Apr. 10, 2014

(30) Foreign Application Priority Data

Oct. 4, 2012 (DE) ..... 10 2012 218 089

(51) Int. Cl.
*F28F 9/007* (2006.01)
*F28F 9/00* (2006.01)

(52) U.S. Cl.
CPC ..... *F28F 9/007* (2013.01); *F28F 9/002* (2013.01); *F28F 2280/00* (2013.01)

(58) Field of Classification Search
CPC ..... F28F 9/007; F28F 9/00; F28F 9/26; F28D 7/00; F16B 21/00; B60K 11/04
USPC ..... 165/67, 176, 149, 153, 168, 140; 180/68.4
See application file for complete search history.

(56) References Cited

U.S. PATENT DOCUMENTS 3,850,146 A * 11/1974 Graham ..... F23M 5/08 110/336
3,938,587 A * 2/1976 Vian ..... 165/76
4,579,184 A 4/1986 Hiramoto
5,570,737 A 11/1996 Tokutake
6,668,956 B1 * 12/2003 Pelage ..... B60K 11/04 180/312
6,742,572 B2 * 6/2004 Muhammad et al. ..... 165/67
(Continued)

FOREIGN PATENT DOCUMENTS

DE 198 57 494 A1 7/1999
DE 102 42 899 A1 4/2003
(Continued)

OTHER PUBLICATIONS

German Search Report, Application No. DE 10 2012 218 089.3, Sep. 4, 2013, 5 pgs.
(Continued)

*Primary Examiner* — Len Tran
*Assistant Examiner* — Gustavo Hincapie Serna
(74) *Attorney, Agent, or Firm* — Paul D. Strain, Esq.; Strain & Strain PLLC

(57) ABSTRACT

Heat exchanger and a retention element for the heat exchanger, the retention element having a receiving region and a spacing element, and the receiving region at least partially receiving the heat exchanger, wherein the receiving region has a contour which substantially corresponds to an outer contour of the heat exchanger, the receiving region having fixing means, by means of which the retention element can be fixed to the heat exchanger, the spacing element protruding outwards from the retention element and protruding beyond the outer contour of the heat exchanger.

14 Claims, 4 Drawing Sheets

(56) References Cited

U.S. PATENT DOCUMENTS

| | | | | |
|---|---|---|---|---|
| 6,971,169 | B2 * | 12/2005 | Terashima et al. | 29/890.046 |
| 7,059,392 | B2 * | 6/2006 | Kovac | 165/140 |
| 7,287,574 | B2 * | 10/2007 | Desai | F28D 1/0435 165/140 |
| 8,312,951 | B2 * | 11/2012 | Bui | F01P 3/18 165/67 |
| 8,499,823 | B1 * | 8/2013 | Shaw et al. | 165/53 |
| 2001/0004010 | A1 * | 6/2001 | Halm | F28F 9/002 165/67 |
| 2003/0051497 | A1 | 3/2003 | Nomura et al. | |
| 2004/0089769 | A1 * | 5/2004 | Carrier | B60K 11/04 248/71 |
| 2006/0054306 | A1 * | 3/2006 | Kent et al. | 165/67 |
| 2007/0246280 | A1 | 10/2007 | Maeda et al. | |

FOREIGN PATENT DOCUMENTS

| | | | | |
|---|---|---|---|---|
| DE | 10 2004 017 339 | A1 | 10/2005 | |
| EP | 0 440 400 | A1 | 8/1991 | |
| EP | 2 189 746 | A1 | 5/2010 | |
| GB | 2 373 571 | A | 9/2002 | |
| WO | WO 97/42049 | * | 11/1997 | B60K 11/04 |
| WO | WO 2005/100058 | A1 | 10/2005 | |
| WO | WO 2010/011452 | A2 | 1/2010 | |

OTHER PUBLICATIONS

European Search Report, Application No. 13187181.6, Jul. 29, 2014, 9 pgs.

* cited by examiner

HEAT EXCHANGER AND RETENTION ELEMENT

CROSS-REFERENCE TO RELATED PATENT APPLICATIONS

This application is based upon and claims the benefit of priority from prior German Patent Application No. 10 2012 218 089.3, filed Oct. 4, 2012, the entire contents of which are incorporated herein by reference in their entirety.

TECHNICAL FIELD

Heat exchanger, having a retention element, having a receiving region and having a spacing element, the receiving region at least partially receiving the heat exchanger.

PRIOR ART

In modern motor vehicles, air conditioning systems are used for the purposes of air conditioning. Depending on the configuration of the individual motor vehicle, various heat exchangers, in particular evaporators, can be used within the air conditioning system in this instance.

In vehicles having relatively high air conditioning demands, relatively large evaporators are generally fitted. These relatively high demands may result, for example, from a relatively large passenger space or from specific operating modes of the air conditioning system.

The heat exchangers or evaporators used generally have different depth dimensions in this instance.

In order to receive the heat exchanger, air conditioning systems generally have a receiving device, in which the heat exchanger can be inserted. In order to be able to integrate the various heat exchangers in the air conditioning system, there are used in the prior art, for example, adapted receiving devices which are specifically cut to a dimension of the heat exchanger.

There are further known inserts which are introduced into the receiving devices in order to enable a heat exchanger of a specific size to be received.

There are further known applications in which foam strips are used between the heat exchangers used and the receiving devices of the air conditioning systems in order to fix the heat exchangers in the receiving device.

The disadvantage of the prior art is that, as a result of the adaptation of the receiving devices to the different dimensions of the heat exchangers, high costs are involved and the resulting assembly complexity is very high. Even when changeable inserts are used, depending on the size and the shape of the changeable inserts, high costs are involved and there is further high production complexity for the inserts and the construction of the receiving devices with the inserts. In the case of a large variety of variants, there is further significant logistical complexity in order to provide the components in accordance with requirements.

STATEMENT OF INVENTION, OBJECT, SOLUTION, ADVANTAGES

An object of the present invention is therefore to provide a heat exchanger having a retention element which can be integrated in a simple and cost-effective manner in receiving devices of different sizes.

The object of the present invention is achieved with a heat exchanger having a retention element having the features according to claim 1.

An embodiment of the invention relates to a heat exchanger and a retention element having a receiving region and having a spacing element, the receiving region at least partially receiving the heat exchanger, the receiving region having a contour which substantially corresponds to an outer contour of the heat exchanger, the receiving region having fixing means, by means of which the retention element can be fixed to the heat exchanger, the spacing element protruding outwards from the retention element and protruding beyond the outer contour of the heat exchanger.

A heat exchanger having a retention element described may advantageously be used in a standardized receiving device of an air conditioning system. By means of the sizing of the spacing element, compensation is achieved between the dimensions of the heat exchanger and the receiving device.

The retention member may be placed on a heat exchanger, whereby the assembly process can be kept simple. As a result of the contour of the receiving region, which corresponds to an outer contour of the heat exchanger, secure retention of the retention element on the heat exchanger is ensured.

It is also preferable for there to be further provided a stop element which determines the maximum insertion depth of the heat exchanger in the receiving region.

As a result of the stop element, the maximum insertion depth of the heat exchanger in the receiving region of the retention element is determined. This ensures secure arrangement of the heat exchanger in the retention element and prevents lateral sliding of the heat exchanger with respect to the retention element.

A preferred embodiment is characterized in that the stop element is formed by a wall which terminates the receiving region at one side.

The formation of the stop element by a wall can be carried out in a particularly simple and cost-effective manner. Furthermore, a flat wall contributes to a smaller structural size of the retention element which is advantageous in particular with regard to the structural space which is available.

It is further advantageous for the receiving region to be substantially w-shaped by means of two opposing curved wall regions which are connected by means of a bead-like connection region.

In many cases, the heat exchangers which are used in air conditioning systems are evaporators. These partially have a w-shaped outer contour at the collection receptacles thereof. As a result of the formation of the retention element in accordance with the outer contour of the heat exchanger, secure arrangement of the retention element on the heat exchanger in ensured.

The bead-like connection region engages in the impact location of the two curved regions of the collection receptacle of the heat exchanger, which makes it easier to position the retention element on the heat exchanger during assembly.

In another advantageous embodiment of the invention, there is further provision for the receiving member to be u-shaped by means of two mutually opposing curved wall regions which are connected by means of a substantially planar connection region.

In order to also be able to advantageously receive heat exchangers with varying outer contours in the retention element, a u-shaped embodiment of the receiving region of the retention element may be advantageous. This u-shaped retention element can advantageously be fitted onto collection receptacles of heat exchangers which have a u-shaped outer contour. Furthermore, the use of a retention element having a u-shaped receiving region is possible even with heat exchangers having the above-described characteristic w-shaped outer contour.

It is further advantageous for the receiving region to surround at least a part-region of the heat exchanger, such as in particular a collection receptacle, and to engage with hook-like elements, which form the fixing means, in recesses of the heat exchanger and/or to engage behind projections of the heat exchanger.

Advantageously, the retention elements are fitted to one or more of the collection receptacles of the heat exchanger. Fitting in the region of the cooling medium pipes and corrugated ribs is significantly more complex in comparison.

The hook-like elements of the retention elements may in this instance engage in a particularly advantageous manner in pre-fabricated recesses or engage behind projections, as produced, for instance, by the peripheral edge of the collection receptacle.

A connection of the retention element and the heat exchanger can advantageously be constituted by the fixing means. The fixing means further exclude undesirable disengagement of the connection.

It is also preferable for the spacing element to be formed by at least one rib, which extends parallel with the stop element and which protrudes in the air flow direction of the heat exchanger via the outer contour of the heat exchanger.

The formation of the spacing element by a rib is particularly advantageous since the structure and the production of the spacing element in the form of a rib is particularly simple and cost-effective production of the spacing element can thereby be achieved.

Advantageously, the spacing element extends parallel with the air flow direction of the heat exchanger since, generally, the longitudinal compensation for the precise reception in the receiving device must also be carried out in this direction.

It is further advantageous for the heat exchanger to have a retention element at both end regions of a collection receptacle, respectively.

This is particularly advantageous since the heat exchanger is thereby supported with respect to the receiving device in the air conditioning system at least at two locations, whereby an oblique position of the heat exchanger inside the receiving device is counteracted. In a particularly advantageous embodiment, the heat exchanger has a retention element at each end region of the two collection receptacles thereof, whereby an oblique position within the receiving device is completely prevented.

In an alternative embodiment of the invention, it is advantageous for the receiving region of the retention element to be smaller in the disassembled state than the region of the heat exchanger to be surrounded so that, in the assembled state, a pressing force acts on the heat exchanger.

As a result of the sizing of the receiving region as described above, it is possible for the retention element to be fixed to the heat exchanger simply by the pressing force which results from the pressing action. The pressing force which results from the deformation of the receiving region by the heat exchanger contributes, in addition to the fixing means, to the secure arrangement of the retention element on the heat exchanger.

It is also advantageous for the retention element to be formed from plastics material.

Production of the retention element from plastics material is advantageous since the production is thereby particularly cost-effective and high variability with respect to the shaping is ensured.

In order, for example, to achieve acoustic decoupling, the retention element may be constructed using dual-component technology. The retention element is formed in this instance as a hard/soft component. Advantageously, ribs or knobs may be arranged at the contact locations between the retention element and a housing. Thermoplastic elastomer materials, such as, for example, rubber, EPDM or SEBS, are preferably suitable for this purpose.

The following materials can advantageously be used in this instance. However, the use is not limited to these materials:

- TPE-O or TPO=thermoplastic elastomers based on olefins, primarily PP/EPDM, for example, Santoprene (Manufacturer: AES/Monsanto)
- TPE-V or TPV=cross-linked thermoplastic elastomers based on olefins, primarily PP/EPDM, for example, Sarlink (Manufacturer: DSM), Forprene (Manufacturer: SoFter)
- TPE-U or TPU=thermoplastic elastomers based on urethane, for example, Desmopan, Texin, Utechllan (Manufacturer: Bayer)
- TPE-E or TPC=thermoplastic polyester elastomers/thermoplastic copolyesters, for example, Hytrel (Manufacturer: DuPont) or Riteflex (Manufacturer: Ticona)
- TPE-S or TPS=styrene block copolymers (SBS, SEBS, SEPS, SEEPS and MBS), for example, Styroflex (Manufacturer: BASF), Septon (Manufacturer: Kuraray) or Thermolast (Manufacturer: Kraiburg TPE)

According to a particularly advantageous development of the invention, an air conditioning system may be provided having a housing for receiving heat exchangers and air channels for the passage of air, a receiving device being provided for receiving a heat exchanger having at least one retention element.

In an alternative embodiment, the object of the invention is achieved by a heat exchanger and a retention element according to claim 12.

An embodiment of the invention relates to a heat exchanger and a retention element for the heat exchanger, the retention element having a receiving region and a spacing element and the receiving region at least partially receiving the heat exchanger, the receiving region being able to be inserted through a pipe/rib block of the heat exchanger, the retention element being able to be fixed to the heat exchanger by means of clamping of the end region of the receiving region and a stop element.

In an advantageous embodiment, it is possible, for example, to combine retention elements according to claims 1 to 10 with retention elements according to claims 12 to 13 on a heat exchanger. For example, additional fixing of a heat exchanger in a housing of an air conditioning system can be achieved by means of an additional retention element according to claim 12.

It is also advantageous for the end region of the receiving region to be formed by means of hook-like elements.

Owing to hook-like end regions, the retention element is self-securing with respect to the heat exchanger. The retention element in this instance simply has to be pushed through the pipe rib block of the heat exchanger. The hook-like elements engage behind the pipe/rib block and thus prevent disengagement of the retention element from the heat exchanger.

Advantageous developments of the present invention are described in the dependent claims and the following description of the Figures.

BRIEF DESCRIPTION OF THE DRAWINGS

The invention is explained in detail below with reference to embodiments and the drawings, in which.

PREFERRED EMBODIMENT OF THE INVENTION

Figure 1:
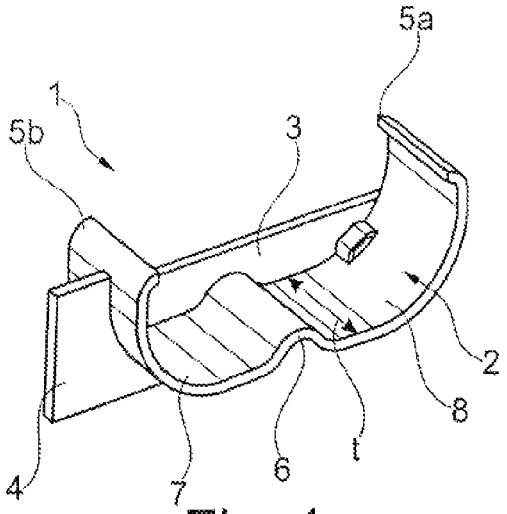
FIG. 1 is a perspective view of a retention element, with a view into the receiving region and towards one of the curved regions.

FIG. 1 is a perspective view of a retention element 1. The retention element 1 substantially comprises a receiving region 2. The receiving region is formed by two curved regions 7, 8. These curved regions 7, 8 are connected to each other by means of a bead-like region 6. The combination of the two curved regions 7, 8 and the bead-like region 6 results in the receiving region 2 being w-shaped.

As an alternative to the bead-like region 6 shown, a substantially planar region may also connect the two curved regions 7, 8 to each other. An alternative receiving region, which is constructed in a u-shaped manner is thereby produced.

The w-shaped receiving region 2 is delimited at one end by a stop element 3. This stop element 3 is formed by a wall. The wall is connected to the two curved regions 7, 8 and the bead-like region 6 and terminates the receiving region 2 laterally.

The stop element 3 acts as a stop for a heat exchanger, which can be inserted into the receiving region 2. The stop element 3 in this instance defines the maximum insertion depth t to which the heat exchanger can be inserted into the receiving region 2 of the retention element 1.

Hook-like elements 5*a*, 5*b* adjoin the upwardly directed curved regions 7, 8. Using these, the retention element 1 can subsequently be fitted to the heat exchanger. To this end, the hook-like elements 5*a*, 5*b* may, for example, engage in pre-fabricated recesses in the heat exchanger or engage behind projections of the heat exchanger.

Figure 1A:
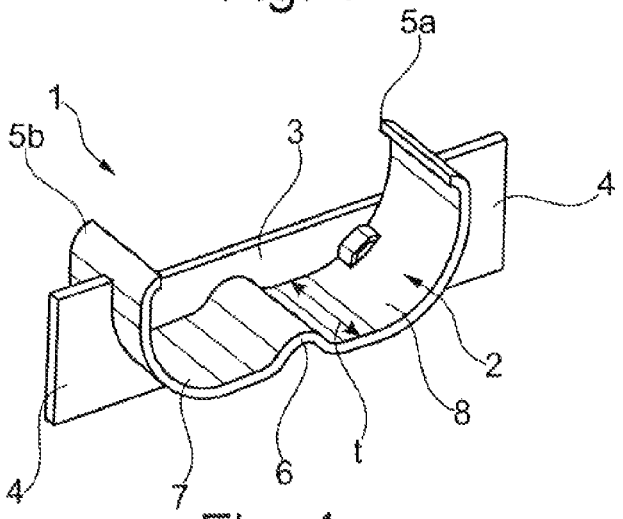
FIG. 1*a* is a view according to FIG. 1 with two spacing elements at opposing end regions of the retention element.
Figure 1B:
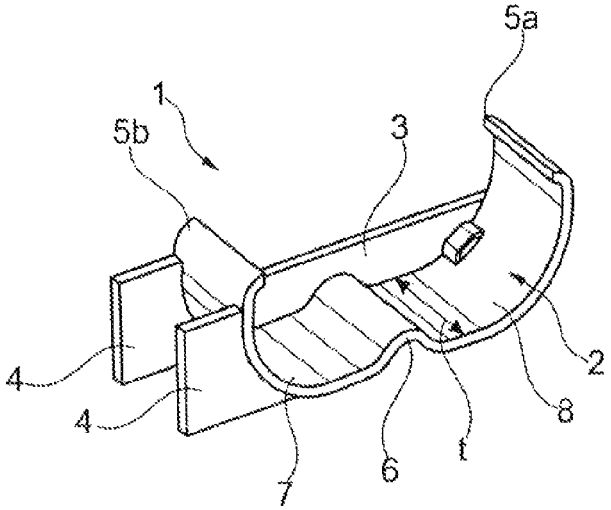
FIG. 1*b* is a view according to FIG. 1 with two spacing elements at the same end region of the retention element.

A spacing element 4 adjoins the outer side of the curved region 7. In alternative embodiments, the spacing element 4 may also be arranged on the curved region 8 or on the stop element 3. A second spacing element 4 may also be provided, and can be provided on the curved region 8 in addition to the spacing element 4 on the curved region 7. It is also possible to provide an embodiment which has a plurality of spacing elements 4 on one of the two curved regions 7, 8. FIGS. 1*a* and 1*b* show corresponding embodiments of the retention element.

The spacing element 4 is formed by a rib, which extends parallel with the stop element 3. The spacing element 4 protrudes beyond the outer contours of a heat exchanger which is inserted in the retention element 1. Alternatively, the spacing element may also be orientated at an angle with respect to the stop element. In place of the stop element 3 which is constructed as a wall, one or more hump-like elements which perform the stop function may also be provided.

The retention element 1 serves to position a heat exchanger in a receiving device of an air conditioning system and to fix it in a predefined position. The spacing element 4 spaces the retention element 1 and consequently also a heat exchanger which is inserted in the retention element 1 with respect to a wall in a receiving region 2 of an air conditioning system.

A receiving device within an air conditioning system is formed in many cases by a cassette-like portion, in which the heat exchanger can be inserted. In order to ensure a secure arrangement of the heat exchanger in the receiving device, the internal dimension of the receiving device in the prior art is adapted to the outer diameter of the heat exchanger. Alternatively, inserts are inserted into the receiving region.

As a result of a different configuration of the length of the spacing element 4, a heat exchanger of predetermined size can be inserted in receiving devices within an air conditioning system and be fixed there by means of the retention element 1. The retention element 1 in this instance compensates for the difference between the external dimensions of the heat exchanger and the internal dimensions of the receiving device.

In alternative embodiments, there may also be provision for the spacing element to have an additional decoupling element, such as, for example, a rubber element. Decoupling can thereby be achieved in addition to the spacing.

The retention element 1 consequently serves to position and orientate a heat exchanger within a receiving device of an air conditioning system.

Figure 2:
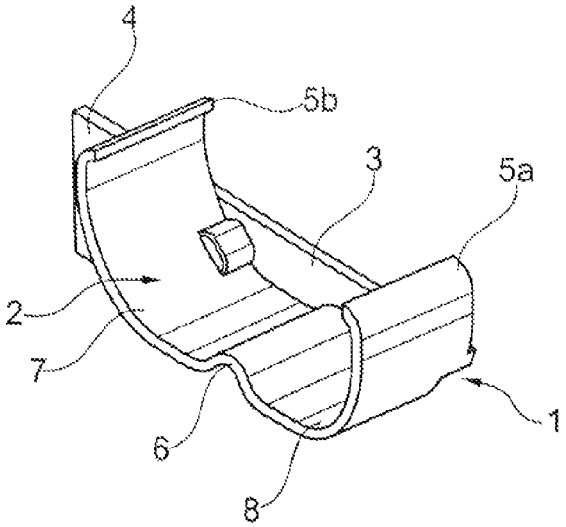
FIG. 2 is another perspective view of the retention element, according to FIG. 1, with a view towards the second curved region.
Figure 3:
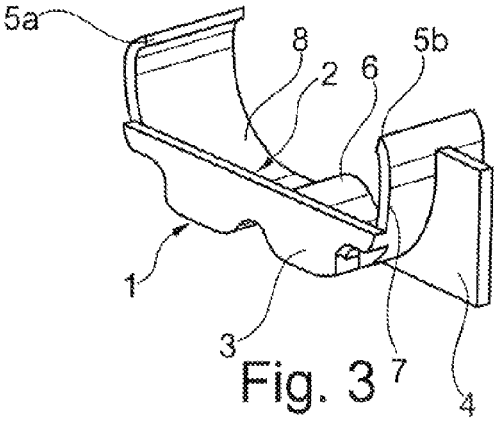
FIG. 3 is a third perspective view of the retention element, according to FIGS. 1 to 2, with a view towards the stop element which is constructed as a wall.

Both the receiving device and the air conditioning system are not illustrated in FIGS. 1 to 3.

The receiving region 2, which follows a w-like form in the example shown of FIG. 1, is adapted to an outer contour of a heat exchanger. Generally, the heat exchanger is an evaporator which has, in particular at the collection receptacle thereof, a characteristic outer contour.

Evaporators which are known today for use in air conditioning systems partially have a w-shaped outer contour at the collection receptacle. As a result of the shaping of the retention element 1 shown, the fitting of the retention element 1 on a w-shaped collection receptacle of a heat exchanger is facilitated.

In this instance, the bead-like region 6 can be used to centre and position the retention element 1 in order to insert the collection receptacle of the heat exchanger into the retention element 1 or to fit the retention element 1 onto the collection receptacle of the heat exchanger. In the assembled state, the bead-like region 6 may engage in the outer contour of the heat exchanger in such a manner that a positioning of the retention element 1 with respect to the heat exchanger is produced by the bead-like region 6.

In the case of a u-shaped embodiment of the receiving region 2, the bead-like region 6 would be replaced by a substantially planar region, whereby the shaping of the receiving region 2 would be carried out in a substantially U-shaped manner. Such an embodiment of the retention element 1 is in particular recommended for heat exchangers having an outer contour which differs from the w-shape. The use of a u-shaped receiving region on a collection receptacle with a w-shaped outer contour may also be provided for.

In another alternative embodiment, a spacing element may also be provided which rests perpendicularly on the stop element 3 and laterally supports the retention element 1 in a receiving device of an air conditioning system. Such an alternative spacing element may be fitted to the retention element 1 together with the spacing element 4 shown in FIG. 1 or alone without the spacing element 4.

If a spacing element which rests perpendicularly on the stop element 3 is provided, the receiving device of the air conditioning system must have corresponding ribs or grooves, in which the alternative spacing element can engage in order to also ensure secure positioning of the retention element 1 and consequently the heat exchanger which is inserted in the retention element 1.

FIG. 2 is another perspective view of the retention element 1 which was already shown in FIG. 1. FIG. 2 shows substantially only one other orientation of the retention element 1.

FIG. 3 shows a third orientation of the retention element 1 which was already shown in FIGS. 1 and 2. In FIG. 3, the viewing angle is now directed not into the open receiving region 2, but instead towards the rear side of the stop element 3, which is constructed as a wall which connects the two curved regions 7, 8 and the bead-like region 6 to each other.

The parallel orientation of the spacing element 4 with the stop element 3 can also be seen in FIG. 3.

Figure 3A:
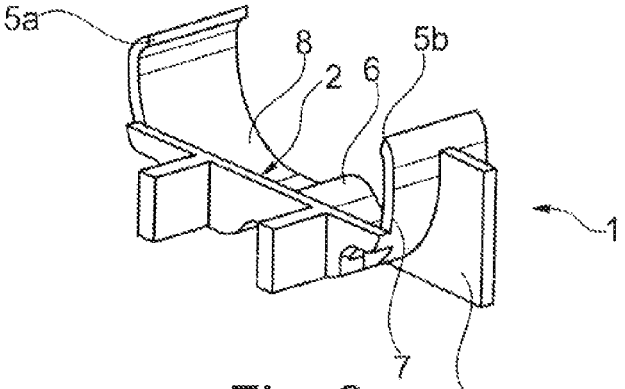
FIG. 3*a* is a view according to FIG. 3 with additional rib elements which are arranged laterally on the stop element.

FIG. 3*a* shows another embodiment of the retention element 1. In addition to FIG. 3, there are now provided in FIG. 3*a* rib elements which are arranged on the outer surface of the stop element 3. These rib elements can space apart the retention element and consequently the heat exchanger with respect to a housing, in which the heat exchanger can be introduced. The additional rib elements thus serve to fix and position the retention element 1 and the heat exchanger in a housing.

In an alternative embodiment of the retention element, there may be provision for the retention element not to have any stop element. In this manner, not only may the retention element be arranged in the lateral end regions of a heat exchanger, but it may also be positioned freely over the entire width of the heat exchanger.

A common aspect of all the embodiments of the previously described Figures is that the retention element 1 is preferably produced from a plastics material. In order to produce an additional decoupling action by means of the retention element 1, there may be provision for the plastics material to be covered with a soft material. To this end, elastomer materials, such as, for example, rubber, EPDM (ethylene propylene diene monomer rubber) or SEBS (styrene block copolymers).

Figure 4:
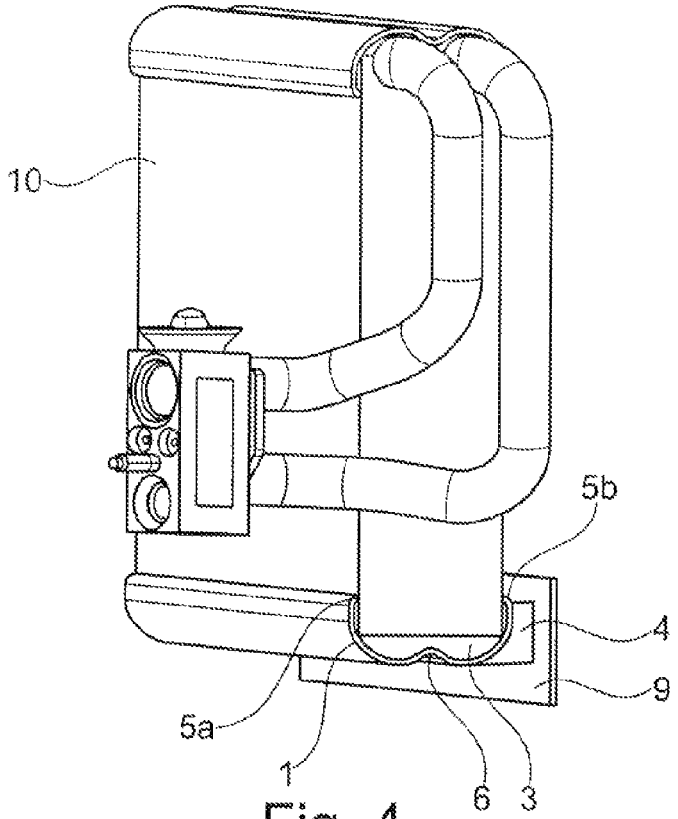
FIG. 4 shows a heat exchanger with a retention element fitted, and a wall of a receiving region, which the retention element abuts by means of its spacing element.

FIG. 4 shows a heat exchanger 10, which is inserted into a retention element 1. The heat exchanger 10 shown is in this instance an evaporator and is connected in FIG. 4 to an expansion valve by means of pipelines. On the lower collection receptacle, in an end region of the collection receptacle, a retention element 1 is placed on the heat exchanger 10.

In a development of the heat exchanger 10 shown in FIG. 4, either a retention element 1 is fitted on both end regions of a collection receptacle, respectively, or a retention element 1 is fitted on both end regions of both collection receptacles, respectively.

It can clearly be seen in this instance that the w-shaped contour of the receiving region 2 is precisely adapted to the outer contour of the collection receptacle of the heat exchanger 10. In an advantageous embodiment, the receiving region 2 of the retention element 1 in the disassembled state is smaller than the collection receptacle of the heat exchanger 10. There is thereby produced in the assembled state a pressing force which the retention element 1 applies to the collection receptacle of the heat exchanger 10. This additionally leads to a better connection and secure arrangement of the retention element 1 on the heat exchanger 10.

FIG. 4 shows how the hook-like elements 5*a*, 5*b* engage behind the projection which is formed between the collection receptacle and the heat exchanger matrix. The retention element 1 is thereby fixed to the heat exchanger 10.

There is further indicated in FIG. 4 a wall 9, which belongs to a receiving device of an air conditioning system. The spacing element 4 supports itself and consequently also the heat exchanger 10 on the wall 9. As a result, it spaces the heat exchanger 10 relative to the wall 9.

In an alternative embodiment, there may be provision for both retention elements, which are each pushed from a side end region over a collection receptacle, to be connected to each other by means of a profile-member. The profile-member may advantageously be produced from a soft plastics material so that an additional sealing and compensation action is thereby provided by it.

In a particularly advantageous manner, the profile-member is constructed in such a manner that it in particular covers the transition between the pipe and rib region of the heat exchanger and the collection receptacle. In this manner, a leakage flow around the collection receptacle can be reduced. The profile-member may in this instance surround the entire outer contour of the collection receptacle, or only part-regions. If the collection receptacle is completely surrounded, openings may be provided, by means of which, for example, condensation can flow away.

Figure 5:
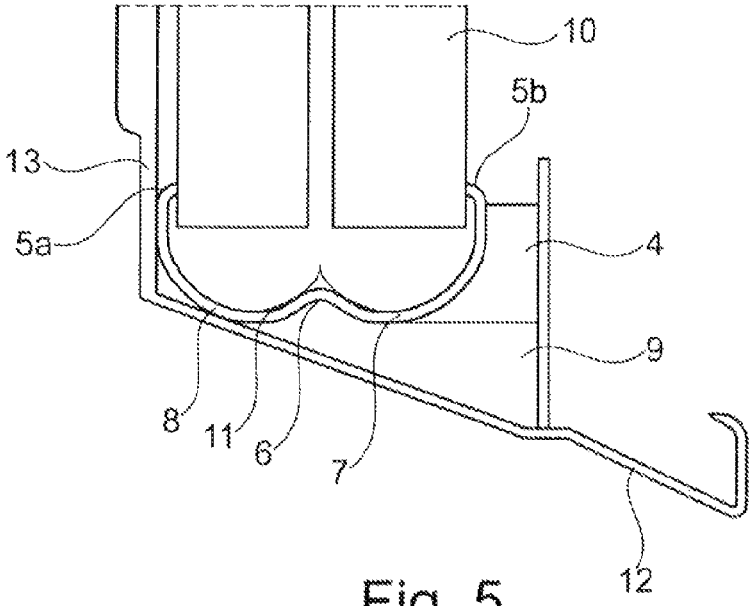
FIG. 5 is a section through a heat exchanger in the direction of the air flow direction, the heat exchanger being inserted in a receiving device of an air conditioning system, the heat exchanger being supported on the receiving device by means of the retention element.

FIG. 5 is a section along the air flow direction of the heat exchanger 10 through the collection receptacle region of the heat exchanger 10. In FIG. 5, the heat exchanger 10 is inserted into a receiving device 12. The wall 9 forms a first spatial delimitation of the receiving device 12, in which the heat exchanger 10 can be inserted. The region of the receiving device 12 is further spatially delimited by a second wall 13 which is substantially opposite the wall 9.

The depth of the receiving device 12, which is produced between the wall 9 and the wall 13, corresponds in this instance to a dimension which is constant, regardless of the heat exchanger 10 actually used.

By means of the retention element 1, which is placed on the heat exchanger 10, the heat exchanger 10 is positioned in this region and fixed between the wall 13 and the wall 9.

In alternative cases, there may also be provided a heat exchanger 10 which has a dimension which differs from the heat exchanger 10 shown in FIG. 5. In order nonetheless to ensure secure positioning of the heat exchanger 10 within the receiving device 12, the retention element 1 is adapted accordingly.

To this end, the length of the spacing element 4 can be varied. In addition, the receiving region 2 which is formed from the two curved regions 7, 8 and the bead-like region 6 can also be adapted to the respective heat exchanger 10. In this manner, it is possible to position heat exchangers with different dimensions in a receiving device 12 of constant depth.

In FIG. 5, the heat exchanger 10 rests with the retention element 1 on the receiving device 12 and is supported at the left-hand side with the curved region 8 against the wall 13 and at the opposing side with the spacing element 4 on the wall 9.

Figure 6:
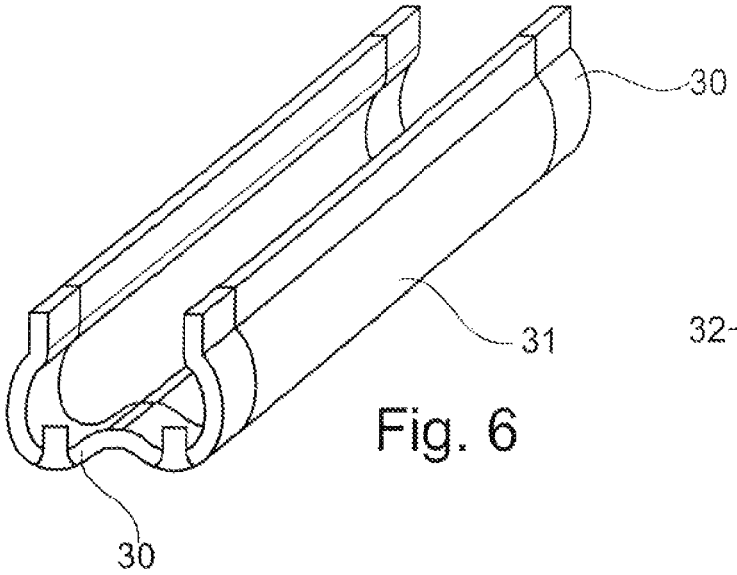
FIG. 6 is a perspective view of two retention elements, which are connected to each other by means of a profile-member.

FIG. 6 is a perspective view of an arrangement of two retention elements 30 having a profile-member 31 which connects the two retention elements 30. The retention elements 30 are in this instance preferably produced from a hard plastics material and connected to a profile-member 31 of a resilient plastics material. The retention elements 30 and the profile-member 31 are formed in this instance in such a manner that they can at least partially engage around a collection receptacle of a heat exchanger.

The profile-member 31 may, for example, comprise a foam material and thus perform an additional sealing and decoupling function.

In alternative embodiments, the retention elements 30 and also the profile-member 31 may be formed from a metal material or as a dual-component construction of a hard material, which is at least partially surrounded by a soft material such as, for example, a foam material.

As an alternative to the profile-member 31 shown in FIG. 6, individual profile strips may be provided and connect the two retention elements 30 to each other.

Figure 6A:
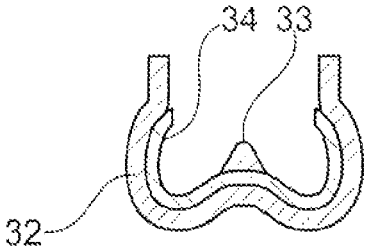
FIG. 6*a* is a sectioned view through a retention element with a covering.

FIG. 6*a* is a cross-section through a retention element 34. The retention element 34 is surrounded with a coating 32. In addition, the retention element 34 has a projection 33 of foam material in the receiving region thereof. The coating which advantageously comprises a foam cladding serves to decouple and seal a heat exchanger.

Figure 7:
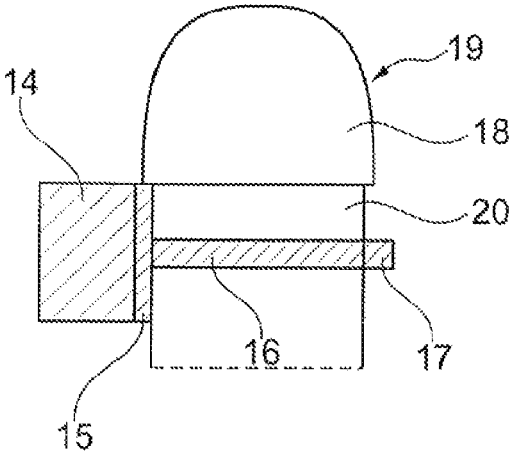
FIG. 7 is a sectioned view of a heat exchanger with an alternative retention element, which is guided through the pipe/rib block of the heat exchanger.

FIG. 7 is a cross-section through a heat exchanger 19. This substantially comprises a collection receptacle 18 and a pipe/rib block 20. There is guided through the pipe/rib block 20 a retention element 21 which receives the pipe/rib block 20 of the heat exchanger 19 along a receiving region 16.

The retention element 21 has a stop element 15 which abuts one of the outer faces of the pipe/rib block. A spacing element 14 is arranged on the stop element 15.

In a similar manner to the retention elements 1 already described in FIGS. 1 to 5, the retention element 21 serves to space the heat exchanger 19 with respect to a housing which surrounds the heat exchanger 19.

The retention element 21 has, at the end region of the receiving region 16 which is formed by two web-like elements, hook-like elements 17. The retention element 21 can be pushed with these hook-like elements 17 through the pipe/rib block 20 of the heat exchanger 19. The hook-like elements 17 engage behind the pipe/rib block 20 at the side opposite the stop element 15 and thus fix the retention element 21 in the pipe/rib block 20.

Figure 7A:
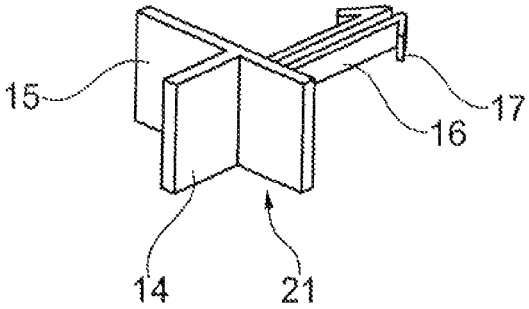
FIG. 7*a* is a perspective view of a retention element according to FIG. 7.

FIG. 7*a* is a perspective view of the retention element 21, as already described in FIG. 7. The spacing element 14 may in this instance be arranged both centrally and offset from the centre of the stop element 15.

Figure 7B:
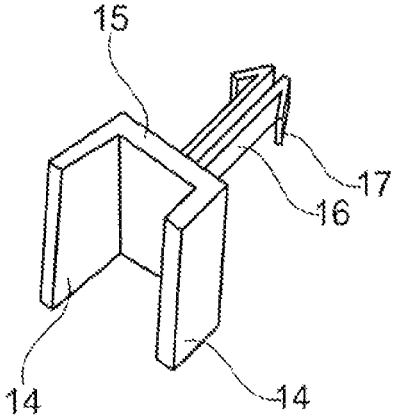
FIG. 7*b* is a perspective view of a retention element according to FIG. 7*a*, but with two spacing elements which are arranged on the stop element.

FIG. 7*b* shows an alternative embodiment of the retention element 21. In this embodiment, the stop element 15 has two spacing elements 14.

Figure 7C:
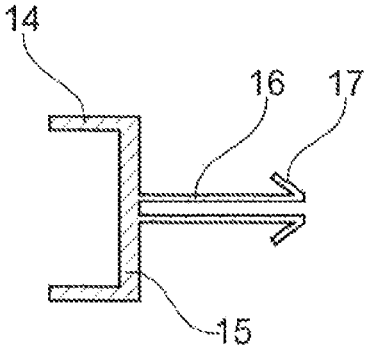
FIG. 7*c* is a plan view of a spacing element according to FIG. 7*b*.

FIG. 7*c* is a plan view of the retention element according to FIG. 7*b*.

The embodiments of the alternative retention element shown in FIGS. 7, 7*a*, 7*b* and 7*c* can each be produced from the same materials as the retention element 1 in FIGS. 1 to 5. The hook-like elements 17 may also have different shapes in alternative embodiments. The object of the hook-like elements 17 is to fix the retention element 21 to the heat exchanger 19. In order to fix the retention element 21 in the heat exchanger 19, clips may, for example, also be provided.

The invention claimed is:

1. A heat exchanger and a retention element for the heat exchanger, the retention element comprising a receiving region, a spacing element, and a stop element, wherein the receiving region at least partially receives the heat exchanger, the receiving region comprising a contour which substantially corresponds to an outer contour of the heat exchanger, wherein the contour of the receiving region comprises two opposing curved wall regions connected by a bead-like connection region such that the receiving region is w-shaped, wherein the receiving region comprises a fixing device for fixing the retention element to the heat exchanger, wherein the bead-like connection region engages a complimentary portion of the housing of the heat exchanger, wherein the spacing element protrudes outwards from the retention element and protrudes beyond the outer contour of the heat exchanger, wherein the stop element is connected to the two opposing curved wall regions and the connection region and determines a maximum insertion depth of the heat exchanger in the receiving region, wherein the stop element is formed by a wall which terminates and bounds the receiving region at one side, wherein the stop element is arranged orthogonally to the two opposing curved wall regions and the connection region.

2. The heat exchanger and the retention element according to claim 1, wherein the fixing device comprises hook-like elements arranged on an end region of the receiving region, wherein the receiving region surrounds an at least part-region of the heat exchanger which form the fixing device, wherein the hook-like elements engage in recesses of the heat exchanger or engage behind projections of the heat exchanger.

3. The heat exchanger and the retention element according to claim 1, wherein the spacing element is formed by at least one rib, which extends parallel with the stop element and extends orthogonally to the two opposing curved wall regions and the connection region, wherein the spacing element protrudes in an air flow direction of the heat exchanger via the outer contour of the heat exchanger.

4. The heat exchanger and the retention element according to claim 1, wherein the heat exchanger comprises a retention element at both end regions of a collection receptacle.

5. The heat exchanger and the retention element according to claim 1, wherein the receiving region of the retention element is smaller in a disassembled state than a region of the heat exchanger to be surrounded so that, in an assembled state, a pressing force acts on the heat exchanger.

6. The heat exchanger and the retention element according to claim 1, wherein the retention element is formed from plastics material.

7. An air conditioning system comprising a housing for receiving heat exchangers and air channels for passage of air, further comprising a receiving device for receiving the heat exchanger comprising at least one retention element, wherein the heat exchanger and retention element are comprised according to claim 1.

8. A heat exchanger and a retention element for the heat exchanger, wherein the retention element comprises a w-shaped receiving region and a spacing element, wherein the receiving region at least partially receives the heat exchanger, wherein the receiving region can be inserted through a pipe/rib block of the heat exchanger, wherein the retention element can be fixed to the heat exchanger by clamping an end region of the receiving region and a stop element.

9. The heat exchanger and the retention element according to claim 8, wherein the end region of the receiving region is formed by hook-like elements which bend back toward the stop element forming acute angles in the end region.

10. The heat exchanger and the retention element according to claim 2, wherein the at least part-region of the heat exchanger is a collection receptacle.

11. A heat exchanger and a retention element for the heat exchanger, the retention element comprising a receiving region and a spacing element, wherein the receiving region at least partially receives the heat exchanger, the receiving region comprising a contour which substantially corresponds to an outer contour of the heat exchanger, wherein the contour of the receiving region comprises two opposing curved wall regions connected by a bead-like connection region, wherein the receiving region comprises a fixing device for fixing the retention element to the heat exchanger, wherein the spacing element protrudes outwards from the retention element and protrudes beyond the outer contour of the heat exchanger, wherein the receiving region is w-shaped and comprises two opposing curved wall regions which are connected by a bead-like connection region, wherein the bead-like connection region engages a complimentary portion of the housing of the heat exchanger.

12. The heat exchanger and the retention element according to claim 11, the receiving region further comprising a stop element which determines a maximum insertion depth of the heat exchanger in the receiving region, wherein the stop element is arranged orthogonally to the two opposing curved wall regions and the connection region.

13. The heat exchanger and the retention element according to claim 12, wherein the stop element is connected to the two opposing curved wall regions and the connection region and determines a maximum insertion depth of the heat exchanger in the receiving region, wherein the stop element is formed by a wall which terminates and bounds the receiving region at one side.

14. An air conditioning system comprising:

a housing for receiving the heat exchanger, air channels for passage of air, wherein a receiving device on said housing is provided for receiving the heat exchanger having at least one retention element, wherein the heat exchanger and the at least one retention element are comprised according to claim 11.

* * * * *